US010736424B2

(12) United States Patent
Donati et al.

(10) Patent No.: US 10,736,424 B2
(45) Date of Patent: Aug. 11, 2020

(54) MECHANISM FOR CHANGING THE TILT OF THE BACKREST HAVING REGARD TO THE SEAT OF A CHAIR

(71) Applicants: DONATI S.P.A., Rodengo Saiano (BS) (IT); ARPER S.P.A., Monastier di Treviso (TV) (IT); LIEVORE ALTHERR MOLINA SL, Barcelona (ES)

(72) Inventors: Armando Donati, Rodengo Saiano (IT); Alberto Lievore, Barcelona (ES)

(73) Assignees: DONATI S.P.A., Rodengo Saiano (BS) (IT); ARPER S.P.A., Monastier di Treviso (TV) (IT); LIEVORE ALTHERR MOLINA SL, Barcelona (ES)

( * ) Notice: Subject to any disclaimer, the term of this patent is extended or adjusted under 35 U.S.C. 154(b) by 476 days.

(21) Appl. No.: 15/322,309

(22) PCT Filed: Jun. 30, 2014

(86) PCT No.: PCT/IB2014/062736
§ 371 (c)(1),
(2) Date: Dec. 27, 2016

(87) PCT Pub. No.: WO2016/001714
PCT Pub. Date: Jan. 7, 2016

(65) Prior Publication Data
US 2017/0135487 A1 May 18, 2017

(51) Int. Cl.

| | |
|---|---|
| ***A47C 1/03*** | (2006.01) |
| ***A47C 1/02*** | (2006.01) |
| ***A47C 7/00*** | (2006.01) |
| ***A47C 7/14*** | (2006.01) |
| ***A47C 1/032*** | (2006.01) |
| ***A47C 1/024*** | (2006.01) |

(52) U.S. Cl.
CPC ..... *A47C 1/03261* (2013.01); *A47C 1/024* (2013.01); *A47C 1/03255* (2013.01); *A47C 7/004* (2013.01); *A47C 7/14* (2013.01)

(58) Field of Classification Search
CPC ..... A47C 1/024; A47C 1/032; A47C 1/03205; A47C 1/03255; A47C 1/03261; A47C 7/004; A47C 7/14
See application file for complete search history.

(56) References Cited

U.S. PATENT DOCUMENTS 5,716,099 A * 2/1998 McDiarmid ..... A47C 1/031 297/284.11
5,871,256 A * 2/1999 Kogai ..... A47C 1/03255 297/300.2

(Continued)

FOREIGN PATENT DOCUMENTS

CA 2882241 A1 * 2/2014 ..... A47C 1/032
DE 2630267 A1 1/1978

(Continued)

OTHER PUBLICATIONS

International Search Report and Written Opinion for International Application No. PCT/IB2014/062736 (dated Oct. 7, 2014) (10 Pages).

*Primary Examiner* — Ryan D Kwiecinski
(74) *Attorney, Agent, or Firm* — Lucas & Mercanti, LLP

(57) ABSTRACT

A mechanism for adjusting the seat of a chair as a result of changing the tilt of the backrest with respect to the seat is provided. The mechanism has a backrest frame and a base frame, as well as a covering element stably combined with the base frame and forming part of the seat. The backrest frame is rotatably constrained to the base frame around a respective rotation axis and tilting with respect to the seat between a position (P1) of minimum tilt and a position (P2) of maximum tilt. Advantageously, the covering element is (Continued)

partially elastically deformable, with the mechanism having deforming means operated by the backrest frame in order to reversibly deform, in the vertical direction, when the covering element as a function of the tilt angle with backrest frame has reached with respect to the position (P1) of minimum tilt.

13 Claims, 4 Drawing Sheets

(56) References Cited

U.S. PATENT DOCUMENTS

| | | | | |
|---|---|---|---|---|
| 6,419,320 | B1 * | 7/2002 | Wang | A47C 1/03238 297/300.3 |
| 9,241,573 | B1 * | 1/2016 | Tsai | A47C 1/03266 |
| 9,622,580 | B2 * | 4/2017 | Slongo | A47C 1/03255 |
| 9,833,074 | B2 * | 12/2017 | Bohmann | A47C 1/03255 |
| 10,159,347 | B2 * | 12/2018 | Costaglia | A47C 1/03255 |
| 2002/0053822 | A1 | 5/2002 | Ware et al. | |
| 2016/0331137 | A1 * | 11/2016 | Costaglia | A47C 31/126 |

FOREIGN PATENT DOCUMENTS

| | | | | |
|---|---|---|---|---|
| EP | 0032839 | A2 | 7/1981 | |
| EP | 0242433 | A2 | 10/1987 | |
| EP | 1982621 | A1 | 10/2008 | |
| EP | 2375938 | B1 | 9/2012 | |
| EP | 2896325 | A1 * | 7/2015 | A47C 1/03272 |
| JP | 2011161123 | A * | 8/2011 | A47C 7/024 |
| WO | 2008041868 | A2 | 4/2008 | |
| WO | WO-2013085214 | A1 * | 6/2013 | A47C 1/03255 |

* cited by examiner

MECHANISM FOR CHANGING THE TILT OF THE BACKREST HAVING REGARD TO THE SEAT OF A CHAIR

CROSS-REFERENCE TO RELATED APPLICATIONS

This application is a 371 of PCT/IB2014/062736 filed Jun. 30, 2014.

FIELD OF THE INVENTION

The present invention relates to a mechanism for adjusting the seat of a chair when the tilt of the backrest changes with respect to the seat itself.

In particular, the mechanism in question is of the type provided with a backrest frame, a base frame having the seat stably constrained thereto and a lever, or another similar raising mechanism, operatively interposed between the seat and the base frame itself, in order to directly or indirectly transmit the tilting movement of the backrest to the seat, or vice versa.

BACKGROUND ART

Chairs comprising a backrest frame, a fixed base frame having the seat constrained thereto and a mechanism for adjusting the seat when the tilt of the backrest changes with respect to the seat itself, are known in the art.

Usually, a covering element made of various materials is placed above the seat and can fully cover the seat on which, once upholstered, the user will sit.

However, the adjusting mechanisms used in such a chairs do not allow the position of the seat to be changed when the tilt of the backrest changes in order to prevent the user from experiencing an uncomfortable feeling of "sinking" in the seat or moving toward the front edge of the latter, in various backrest tilts.

To overcome this drawback, chairs provided with adjusting mechanisms comprising means for synchronizing the position of the seat with respect to that of the backrest, are known. For example, such synchronizing means are provided with a first frame which can be combined with the backrest, or backrest frame, a second frame which can be combined with the seat, or seat frame, movably constrained to the aforesaid base frame of the chair, and a mechanism for synchronously moving said first frame and said second frame with respect to one another. Such synchronizing means are described, for example, in the European Patent EP2375938B1 in the name of the Applicant.

Such synchronizing means, described in the above mentioned Patent, are very efficient and provide both the technical effect of synchronizing the movement of the seat to that of the chair backrest, and the effect of preventing the user from feeling to "sink" in the seat or to slide outside the latter, when the backrest is in its maximum reclined position. The particular synchronization mechanism described in the above-mentioned Patent allows the achievement of this result because, when the backrest is partially or fully reclined, the seat, being anyway movable with respect to the base frame of the chair, moves so as to maintain the height of its front portion always slightly lower than the height reached by the rear portion.

However, the drawback of the herein described synchronizing means is their complexity and the use of a large number of mutually movable components. In particular, the seat always comprises a fixed base frame and a movable seat frame which is somehow constrained to the base frame and moves with respect to it.

Thus, for example, the aforementioned adjusting mechanism of the synchronizing type, is not very suitable for traditional chairs having four fixed side legs, since these have to be made so as to limit the number of components and their structural and operational complexity, for allowing to be constructional simple and therefore to be cost effective.

It is therefore an object of the present invention to provide an adjusting mechanism for adjusting the seat of a chair when the tilt of the backrest changes, which can apply to any kind of chair and prevents the user from feeling uncomfortable when the tilt of the backrest changes with respect to the seat.

It is a further object of the present invention to provide a mechanism, and therefore a chair, which is structurally simple and easy to be assembled while allowing in any case to effectively change the tilt of the backrest with respect to the seat.

SUMMARY OF THE INVENTION

These and other objects are achieved by the present adjusting mechanism for adjusting the seat of a chair when the tilt of the backrest changes with respect to the seat itself, between a position of minimum tilt and a position of maximum tilt, according to the first independent claim and the respective dependent claims.

The adjusting mechanism for adjusting the seat of a chair when the tilt of the backrest changes with respect to such seat, according to the present invention, comprises a backrest frame and a base frame, as well as at least one covering element stably combined with said base frame and forming at least part of said seat, wherein such backrest frame is rotatably constrained to the aforesaid base frame around a respective rotation axis and thus tilts with respect to the seat between a position of minimum tilt and a position of maximum tilt. Advantageously, in the adjusting mechanism of the present invention the covering element is supposed to be at least partially elastically deformable, and deforming means, operated by the backrest frame, are provided to reversibly deform, at least in the vertical direction, at least part of the aforesaid covering element as a function of the tilt angle the backrest frame has reached.

When the user tilts the backrest from the position of minimum tilt, this solution, without using any complex and expensive synchronizing mechanisms based on a seat frame at least rotatably constrained to the base frame, allows, for example, to raise at least partially the seat, at least preferably at a front portion of the seat itself, thanks to the deformation of the aforesaid covering element, and allows to give the user greater comfort because when he/she tilts the backrest he/she does not experience any unpleasant feeling of sliding forward.

According to a specific aspect of the present invention, not only said deforming means reversibly deform the covering element in the vertical direction, but also in a substantially horizontal direction by lengthening it. In practice, given the constraint that stably combine the covering element with the base frame, such a covering element is raised and drawn preferably toward the rear portion of the seat.

According to another aspect of the present invention, the aforesaid deforming means comprise at least one lever rotatably constrained to the base frame and rotatably operated by the backrest frame, wherein such a lever has at least one arm able to rotate between a first position, in which the backrest is in its position of minimum tilt, and a second position, in which the backrest is in its position of maximum tilt, and vice versa. Advantageously, the aforesaid lever arm is arranged between the base frame and the covering element, and is shaped so as to directly or indirectly deform, in a reversible manner, at least part of such a covering element at least when said lever arm, during its rotation, reaches one or more positions between, or at, said first position and/or said second position.

In practice, in this way, it is possible to guarantee to the user the feeling and the effect usually provided by more complex and known synchronizing means. It is possible to provide the user a feeling of not sinking in the seat when the backrest is tilted, thanks to the arrangement of the afore said lever arm between said base frame and said at least partially elastically deformable covering element and to the shape of such arm allowing to reversibly deform such a covering element when it reaches a position between, or coincident to, at least one of its maximum and minimum rotation positions—corresponding to predetermined tilt angles the backrest frame has reached.

In fact, as apparent to one skilled in the art, when the backrest is tilted rearward towards its maximum tilt, the aforesaid lever, rotatably operated by the backrest frame, can be shaped so as to raise at least part of the seat, preferably a front portion of the latter—i.e. far from the respective backrest—as a result of the deformation of the covering element, which remains stably combined with the base frame, thereby guaranteeing to the user a feeling similar to what the conventional synchronizing mechanisms provide between backrest and seat.

It should be noted that, thanks to the solution introduced herein, the mechanism is made by a number of components smaller than the synchronized one, since the frame of the seat movable with respect to the base frame is eliminated, nevertheless obtaining similar effects.

According to a preferred but not fundamental aspect of the present invention, the aforesaid lever provided with an arm intended to deform the upholstering element of the seat, is integral with the backrest frame, being for example a part of it, and is therefore constrained to the base frame around the same rotation axis of the backrest frame, that is the same pivot axis of the backrest frame to the base frame.

According to another preferred aspect of the present invention, in the adjusting mechanism for adjusting the seat, the aforesaid at least one lever arm has to be combined with, for example by a constraint with one or more degrees of freedom, to the covering element which is at least part of the seat and the aforesaid first position the lever reaches has to be a lowered position with respect to the base frame and the aforesaid second position the lever reaches has to be a raised position, such that the lever arm directly or indirectly deforms upwards at least part of the aforesaid covering element.

In a preferred embodiment of the mechanism according to the present invention, the aforesaid lever arm forms a first crank and the mechanism comprises at least one second crank rotatably constrained to the base frame, directly or indirectly, and at least one crossbar directly or indirectly rotatably constrained to the lever arm (i.e. the first crank) and to the aforesaid second crank, for rotationally moving the second crank during the rotation of the first crank, i.e. the lever arm, between said first position and said second position such a lever arm reaches, said at least one second crank and/or said at least one crossbar being shaped so as to reversibly deform the covering element, directly or indirectly.

In a preferred embodiment of the invention, if the aforesaid at least one first and one second cranks connected to one another by a respective crossbar are used, then such at least one first and one second cranks as well as the respective crossbar can be shaped such that the front crank, i.e. the one farther from the backrest frame, raises more than the rear crank, i.e. the one closer to the backrest frame, when the backrest is rotated from its position of minimum tilt toward its position of maximum tilt, so as to guarantee to the user a more effective sitting comfort.

According to a particular aspect of the invention, the aforesaid covering element can be made of a plastic material comprising a polypropylene copolymer and a percentage of a synthetic or natural elastomer.

Furthermore, such a covering element can comprise, on its inner side, a first coupling for directly or indirectly rotatably constraining the aforesaid at least one lever arm (or first crank) to the covering element forming at least part of the seat. Moreover, said covering element can comprise, still on its inner side, at least one second coupling for directly or indirectly rotatably constraining the aforesaid at least one second crank (if present).

According to another particular embodiment of the invention, said at least one first coupling and said at least one second coupling are arranged at a central position of the covering element. Additionally, said covering element can also comprise a portion perimetrical with respect to said at least one central portion geometrically shaped so as to facilitate the deformation of said covering element. Such a perimetrical portion can preferably comprise a plurality of weakening slots.

Finally, said mechanism for changing the tilt can also comprise returning elastic means for returning the backrest frame, that preferably include at least one spring constrained both to the lever arm (or first crank) and to the base frame of the chair.

BRIEF DESCRIPTION OF THE FIGURES

These and other aspects of the present invention will become more apparent to the one skilled in the art from the following description of various preferred embodiments of the present invention, given by way of non-limiting example, with reference to the attached figures, in which.

DETAILED DESCRIPTION OF A PREFERRED EMBODIMENT OF THE PRESENT INVENTION

Figure 1:
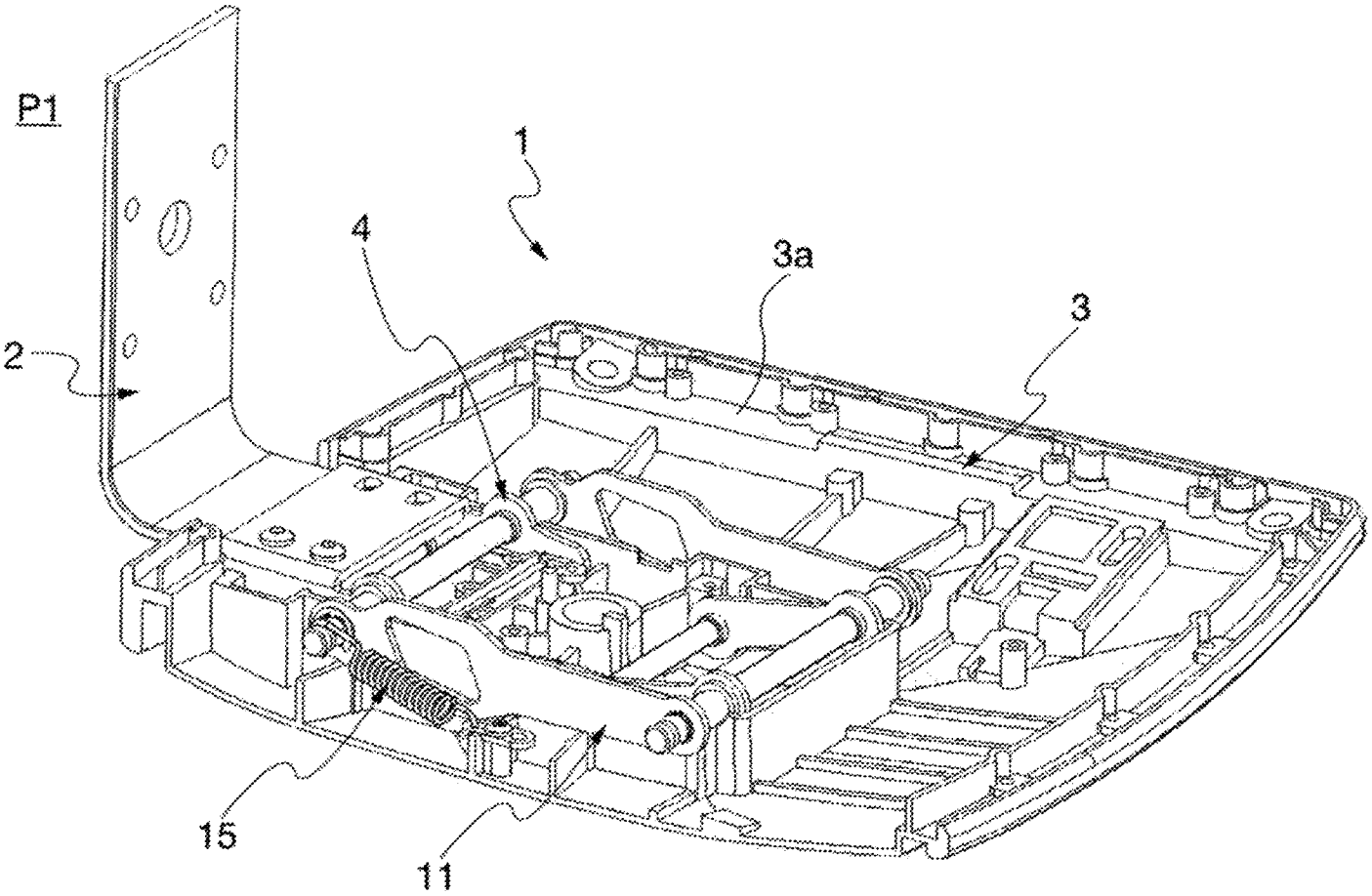
FIG. 1 shows an axonometric view of the mechanism according to the invention, without the covering element and with the backrest in a position of minimum tilt.

Particularly referring to the attached figures, according to a particular aspect of the present invention a mechanism for adjusting the seat of a chair when the tilt of the backrest with respect to such a seat changes, is referred to with the numeral 1.

Figures show this mechanism 1 comprising a backrest frame 2 allowing a preferably padded backrest (not shown herein) to be made integral therewith according to known technique, a base frame 3 having a seat combined therewith and the backrest frame 2 being rotatably constrained thereto by means of a pin 4*a*, and a covering element 5 forming at least part of said seat and being stably combined with the base frame 3.

Figure 2:
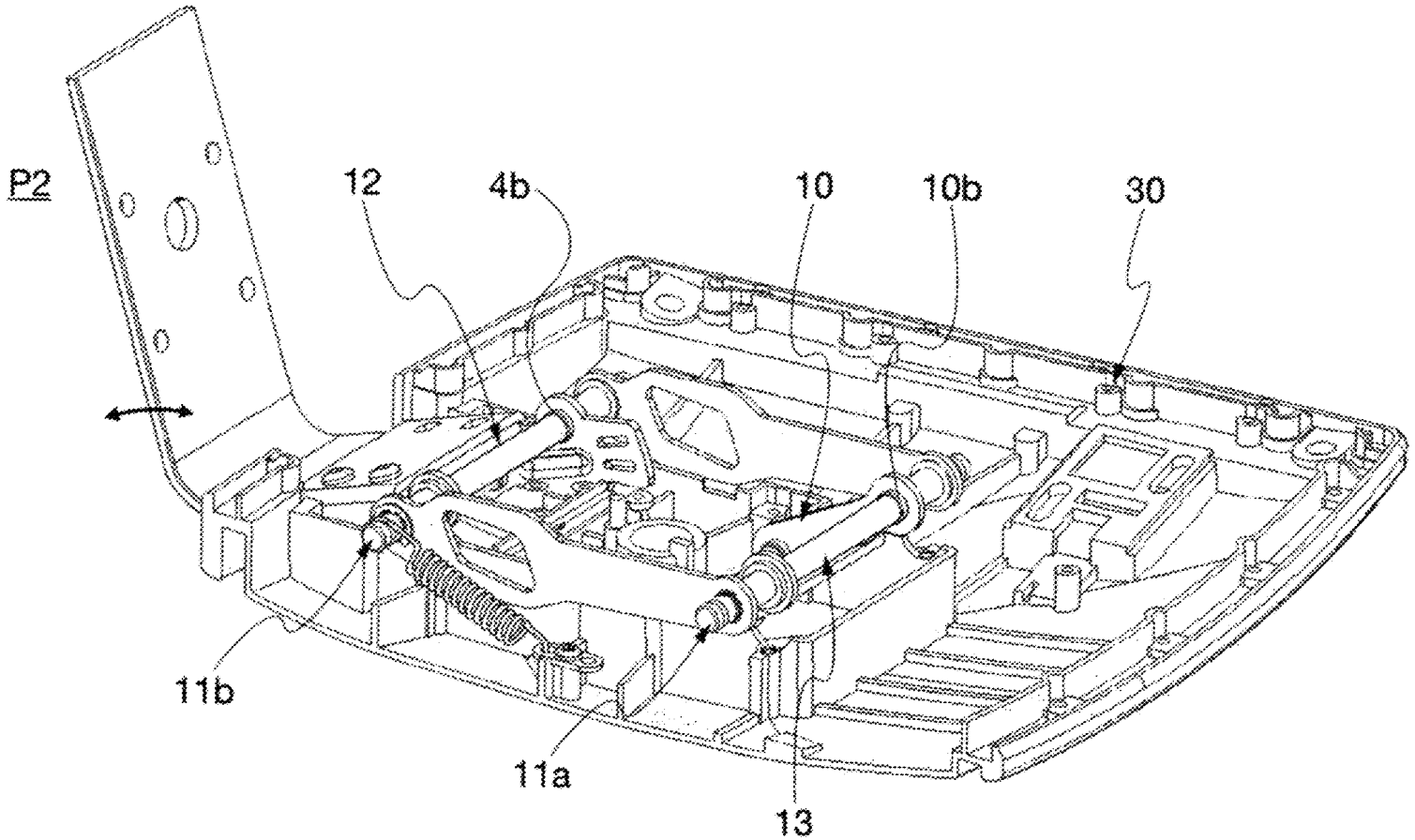
FIG. 2 shows an axonometric view of the mechanism of FIG. 1, without the covering element of the base and with the backrest in a position of maximum tilt.

The backrest frame 2 is shaped in a known manner, for example through suitable limit stops, to be able to tilt by rotating around the axis of the pin 4*a*, between a position (P1) of minimum tilt—shown in FIG. 1—and a position (P2) of maximum tilt—shown in FIG. 2—with respect to the base frame 3, and therefore with respect to the seat, in response to a convenient force the user applies on the backrest.

According to a particular aspect of the present invention, in the adjusting mechanism 1 for adjusting the seat when the tilt of the herein illustrated backrest changes, the aforesaid covering element 5 also has to be integrally, and preferably rigidly constrained to the base frame 3 of the seat, further comprising a padding layer (not shown herein) upholstering this covering element 5. In the embodiment shown herein, the covering element 5 and the respective padding form the seat of the chair having the adjusting mechanism 1 applied thereto.

Preferably, this covering element 5 is fastened to the base frame 3 of the seat, for example at a perimetrical frame thereof, by means of a plurality of screws (not shown herein) housed in a corresponding plurality of passages 30 and threaded blind holes 31 that are, respectively, on the base frame 3 and the covering element 5. However it should be noted that other different connecting means between the covering element 5 and the base frame 3 such as, for example, snap clamps or gluing or mechanical interference means, are still within the protection scope required herein as long as they allows the aforesaid covering element 5 to be stably combined with the respective base frame 3.

Advantageously, said covering element 5 is at least partially elastically deformable. Furthermore, according to a preferred aspect of the present invention, the covering element 5 is formed in one piece which can be made of a material rigid enough to support a soft padding while deformable enough to allow a reversible elastic deformation of this element 5 at least in the vertical direction.

It should be noted that, according to a preferred aspect of the present invention, the covering element 5 not only can be elastically deformable in a vertical direction but also it can be elastically deformable in a substantially horizontal direction, by lengthening it.

It should be noted that "elastically deformable" means herein, generically, the capability of a given body/element of undergoing a given deformation when a suitable force is applied thereto and returning to its undeformed shape when the applied force ceases or when an opposite force is applied thereto, without undergoing permanent deformations.

Thus, it should be noted that such a covering element 5 can be preferably made of a plastic material, such as, for example, a material comprising a polypropylene copolymer and an elastomer, for example in a percentage equal to 5%, nevertheless, it should be noted that a covering element 5 made of a plastic material and having the above mentioned requirements still falls within the protection scope of the present invention.

The adjusting mechanism 1, according to a further preferred aspect of the present invention, further comprises mechanical deforming means, for example one or more levers 4 constrained to the base frame 3, which are operated by the backrest frame 2 and shaped so as to be able to deform, at least in the vertical direction, i.e. by raising and/or lowering, at least part—preferably the front portion—of the aforementioned covering element 5, as a function of the tilt angle the backrest frame 2 itself has reached from its position (P1) of minimum tilt.

Preferably, if the covering element 5 is elastically deformable both in the vertical direction and in the horizontal direction, then such mechanical deforming means 4 allow not only the covering element 5 to be raised and possibly lowered, but also to be lengthened and possibly shortened, also in a substantially horizontal direction. Basically, since said covering element 5 and the respective base frame 3 are rigidly, or anyway stably, constrained to each other, not only such a covering element 5 can be raised by mechanical deforming means 4, but also horizontally "stretched", and preferably lengthened toward the rear portion of the seat, i.e. toward the backrest frame of the chair.

As said, when the user wants to change the tilt of the backrest, this solution guarantees to the user a sitting comfort similar to that achievable by the traditional synchronizing means based on a backrest frame that is at least rotatable.

Figure 4A:
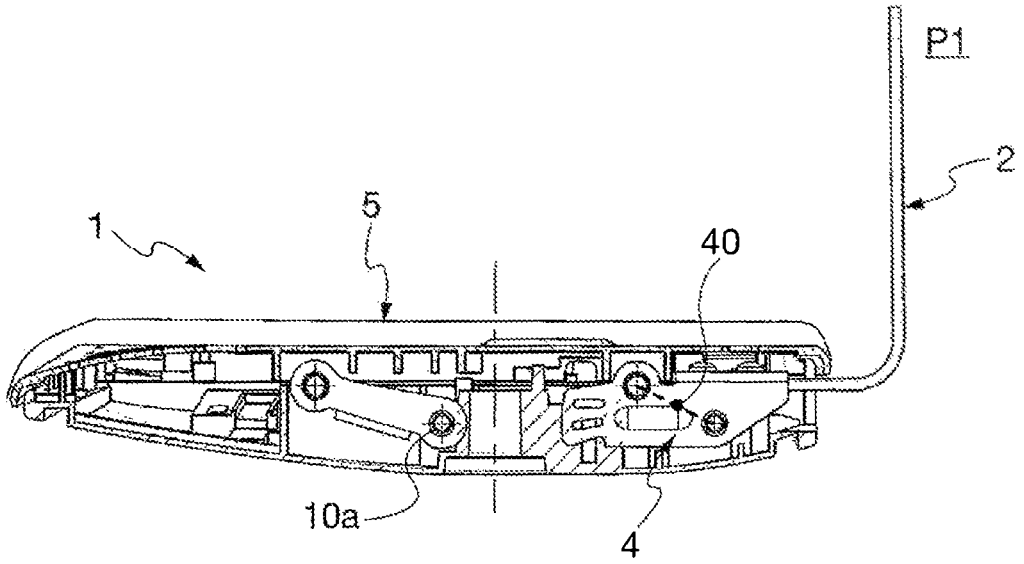
FIG. 4*a* shows a side view of the first and second cranks of the mechanism in their first position.

According to a preferred aspect of the present invention, such deforming means comprise at least one lever 4 that is pivoted, i.e. rotatably constrained, to the base frame 3, and rotationally operated by the backrest frame 2 and provided with at least one swivel raising arm 40 (extending in a direction depicted by the dotted line in FIG. 4*a*) which is shaped so as to reversibly deform, directly or indirectly, at least part of the covering element 5 during its rotation caused by the backrest frame 2.

In particular, the aforesaid arm 40 is rotatably operated by the backrest frame 2 between a first position, wherein said backrest frame 2 is in its position (P1) of minimum tilt, and a second position wherein such a backrest frame 2 is in its position (P2) of maximum tilt. Such an arm 40, preferably, but not necessarily, positioned under the covering element 5, is further shaped so as to directly or indirectly, and at least partially, reversibly deform such a covering element 5 as a function of the rotation angle it has reached moving from its first to its second position, and vice versa.

It should be noted that, although deforming means comprising one or more swivel levers 4 constrained to the base frame 3 of the chair and rotationally operated by the backrest frame 2 have been illustrated herein, any other mechanism, known to one skilled in the art, operated by the rotation of the aforesaid backrest frame 2 and able to raise and/or lower the aforesaid at least partially elastically deformable covering element 5, such as for example a mechanism with opposite wedges, or an inclined slider, or the like, falls within the herein required protection scope.

In the particular embodiment of the adjusting mechanism 1 shown herein, the aforesaid deforming means comprise two parallel levers 4 pivoted to the base frame 3 and both provided with at least one swivel arm 40.

As it can be seen in figures, each of these levers 4 is integral with the backrest frame 2 and, in particular, is an extension thereof extending at the base frame 3, and then pivoted at 4*a*—which is, as said, the pin of the backrest frame 2 on the base frame 3—so as to rotate integrally with the backrest frame 2 around the same rotation axis of the latter, with respect to the base frame 3 of the chair.

It will be noted immediately that, in this embodiment, the arm 40 of each lever 4 is thus generically rotationally operated around the pin 4*a* by the backrest frame 2 between a first lowered position, corresponding to the position (P1) of minimum tilt of the backrest frame 2, and a second raised position, corresponding to the position (P2) of maximum tilt of the backrest frame 2.

Figure 4B:
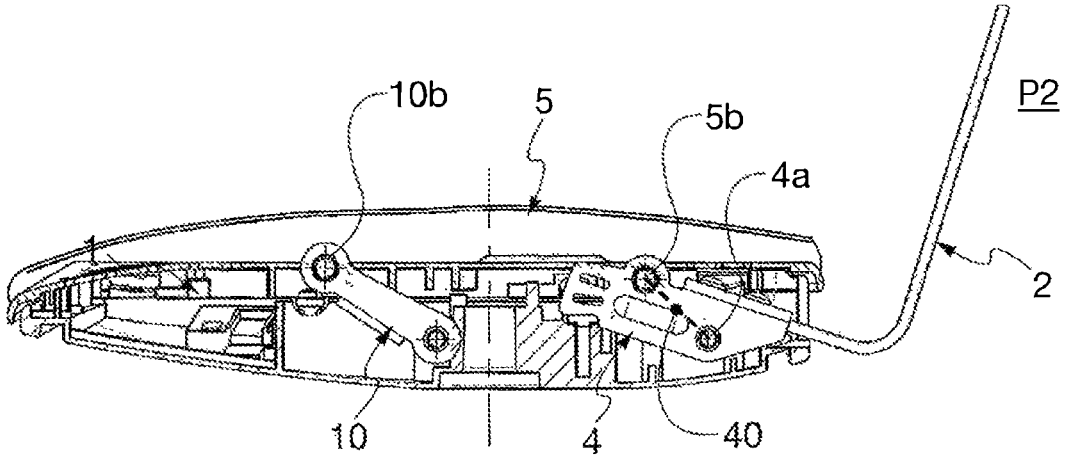
FIG. 4*b* shows a side view of the first and second cranks of the mechanism in their second position.

In addition it should be noted that, in this embodiment, the levers 4 integral with the backrest frame 2, together with the portion of the latter placed at the point 4*a* in which it is hinged to the base frame 3, are rocker levers pivoting around the pin 4*a* and having an arm (to the right in FIGS. 4*a* and 4*b*) operated by the force the user applies on the backrest frame 2 and an arm 40 able to directly or indirectly transmit this force to the aforesaid covering element 5.

Although in the embodiment of the invention described herein there are two levers 4 integral with the backrest frame 2, the number and shape of these levers can be different, nevertheless falling within the protection scope required herein, provided that their arrangement allows at least one lever 4, at least rotatably constrained to the base frame 3 of the chair and provided with at least one swivel arm 40, to be rotationally operated by the backrest frame 2 such that such a swivel arm 40 can rotate between a first position, in which the backrest frame 2 is in the aforesaid position (P1) of minimum tilt, and a second position, in which such a backrest frame 2 is in the aforesaid position (P2) of maximum tilt, or vice versa.

According to the present invention, as mentioned, each arm 40 of each lever 4 or, more generically, at least one arm 40 of at least one lever 4, is shaped so as to directly or indirectly and reversibly deform at least part of the aforesaid covering element 5, at least when such an arm 40 reaches at least one its predetermined angular position set by the tilt of the backrest frame 2.

In particular, in the embodiment of the invention shown herein, the arm 40 of each lever 4 is shaped so as to gradually deform part of the covering element 5 when, due to the user operating the backrest, the backrest frame 2 is caused to rotate thus leaving its position (P1) of minimum tilt toward its position (P2) of maximum tilt. In this case, each arm 40 is formed so that the deformation which the covering element 5 is subjected to, is a raising deformation and such a raising, with respect to the base frame 3 and therefore with respect to the ground, increases due to increase of the tilt of the backrest, i.e. of the frame 2, caused by the user himself.

Advantageously, according to a preferred aspect of the present invention, the two parallel levers 4 are arranged between the base frame 3 and the covering element 5, i.e. they are in the space defined by the base frame 3 and the covering element 5 (see FIGS. 4*a* and 4*b*) and are hinged to the base frame 3 of the chair, such that the respective raising arm 40 can rotate as a function of the tilt the backrest frame 2 has reached through at least part of the change of the tilt between its position P1 of minimum tilt and its position P2 of maximum tilt, and vice versa.

Basically, the two levers 4 have their raising arms 40 pivoted at 4*a* to the base frame 3 and are shaped so as to increasingly raise, directly or indirectly, an elastically deformable portion of the afore said covering element 5 when the tilt of the backrest frame 2 increases from its position (P1) of minimum tilt toward its position (P2) of maximum tilt. In other words, said first position the arm 40 of each lever 4 reaches is a lowered position with respect to the base frame 3 and thus with respect to the ground, and said second position the arm 40 reaches is a raised position in which, when the backrest frame 2 is caused to rotate toward its position (P2) of maximum tilt, since such an arm 40 of each lever 4 is mechanically combined with the covering element 5, then it directly or indirectly deforms at least part of the covering element 5 at least upward and preferably also by horizontally lengthening it towards the rear portion of the seat.

In the particular embodiment of the adjusting mechanism 1 herein illustrated, the two parallel levers 4, or better the respective arm 40, form two parallel first cranks hinged to the base frame 3 and rotatably connected to two crossbars 11 in their turn rotatably constrained to two second cranks 10, which are also rotatably constrained to the aforesaid base frame 3.

In this case, each of the two second cranks 10 is hinged to the base frame 3 at one end 10*a* and is also hinged to the respective crossbar 11 at the other end 10*b*. Such second cranks 10 are shaped too so as to reversibly deform, directly or indirectly, the aforesaid covering element 5 through at least part of their rotation.

In practice, the articulated linkage hinged on the base frame 3 and formed by a pair of first cranks 40 (i.e. the arms of the levers 4), a pair of second cranks 10 and the respective connecting crossbars 11 is of the four-bar linkage type. It should be noted that each crank 40 is hinged at 4*b* to a transverse stiffening pin 12 connecting the free ends of such first cranks 40, and each second crank 10 is hinged at 10*b* to a further common transverse stiffening pin 13 and each crossbar 11 is hinged to two pins 12 and 13, at its ends 11*a* and 11*b* and is therefore rotatably and indirectly constrained to the two first cranks 40 and to the two second cranks 10.

Preferably, the first cranks 40 and the second cranks 10, as well as the respective crossbars 11, are shaped such that, while they rotate with respect to the base frame 3 due to the backrest frame 2 operated from its position (P1) of minimum tilt toward its position (P2) of maximum tilt, the second cranks 10 arranged at the front of the seat, i.e. farther from the backrest frame 2, raise more than the first cranks 40, so as to improve the seat comfort for the user.

In other words, the above described four-bar linkage, or even a more general four-bar linkage formed by one or more first cranks 40, one or more second cranks 10, and one or more respective crossbars 11, according to a particular aspect of the present invention, is shaped so as to ensure that the front portion of the covering element 5 is raised to a larger extent with respect to the rear portion of such a covering element 5 when the user tilts the same backrest frame 2, lowering it. As well known in the art, this result can be achieved, for example, with a different length of the first cranks 40 with respect to the second cranks 10, the first and second cranks 40, 10 being still hinged to the base frame 3 at the same height.

In the first embodiment shown herein, the covering element 5 comprises, on its inner side 5*a*, two first couplings 20 to only rotatably constrain the two first cranks 40 to the covering element 5 and two second couplings 21 to only rotatably constrain the two second cranks 10 to the covering element 5.

In particular, according to the embodiment described herein, the transverse pin 12 connecting the two first cranks 40 (or arms of the levers 4) is rotatably constrained to the two first couplings 20 while the other transverse pin 13 connecting the aforesaid second cranks 10 is rotatably constrained to the two second couplings 21. In this way, therefore, the two pairs of cranks 40 and 10 are rotatably, though indirectly, constrained to the first two couplings 20 and the two second couplings 21.

Basically, during the rotation of the two first cranks 40 and the resulting rotation of the two second cranks 10 between their first position and their second position, the covering element 5 is reversibly deformed because, being the pairs of first and second cranks 40, 10 integral with the covering element 5 by means of the first and second couplings 20 and 21, their rotation raises and lowers such a covering element 5, reversibly deforming it. In fact, these first and second couplings 20 and 21, which are integrally formed with the covering element 5, force the latter to change its shape as the backrest is being tilted with respect to the seat.

It should be noted that, as clear to the person skilled in the art and as previously mentioned, although a four-bar linkage mechanism based on crank and crossbar pairs constrained to each other has been described herein, any other number of cranks and crossbars can be equally used.

According to a particular embodiment of the adjusting mechanism 1 described herein, the two first couplings 20 and the two second couplings 21 are arranged at a central portion 5*b* of the covering element 5.

According to a preferred aspect of the present invention, such a central portion 5*b* of the covering element 5 is reversibly deformable so as to be raised and lowered with respect to the base frame 3 and preferably also lengthened and shortened toward the rear portion of the seat.

Further, the covering element 5 also comprises a perimetrical portion 5*c* with respect to the central portion 5*b*, preferably forming a kind of frame of said central portion 5*b* and constrained to the base frame 3, which is geometrically shaped for facilitating the deformation of the covering element 5 during the movement of the backrest between the position (P1) of minimum tilt and the position (P2) of maximum tilt. In the case shown in FIG. 3, such a perimetrical portion 5*c* comprises, for this reason, a plurality of weakening slots 5*d* facilitating the deformation of the central portion 5*b* with respect to the same perimetrical portion 5*c* having its ends stably constrained to the base frame 3 of the chair.

Figure 3:
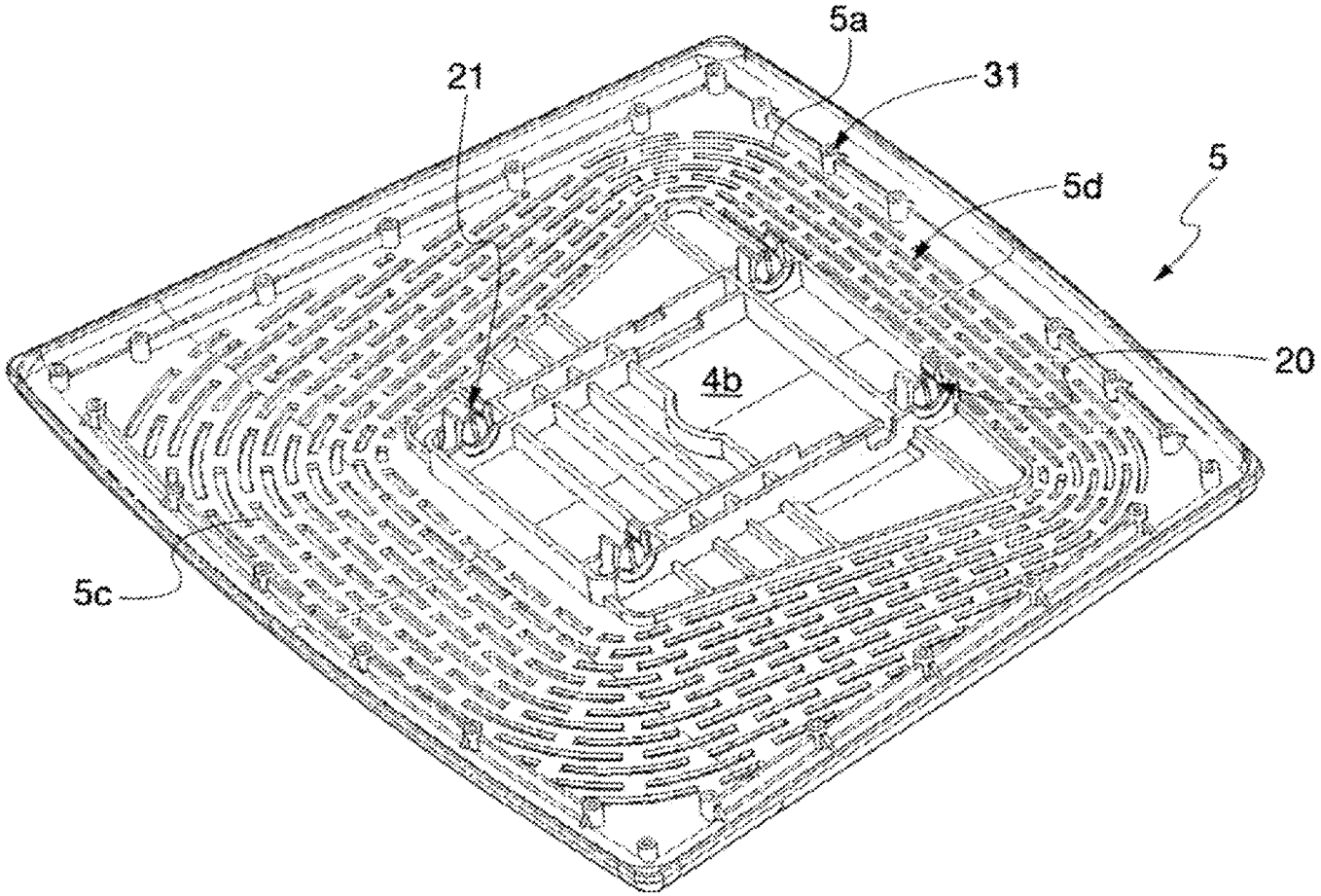
FIG. 3 shows an axonometric view of the interior side of the covering element for the base.

Preferably, as shown in FIGS. 2 to 4, the mechanism 1 further comprises elastic returning means 15 for returning the backrest to its position (P1) of minimum tilt, interposed between the base frame 3 and the rotatable backrest frame 2. In particular, according to the embodiment described herein, such elastic returning means 15 comprise two springs, arranged at opposite sides 3*a*, 3*b* of the base frame 3 of the seat, in parallel with the two crossbars 11 and constrained to the two first cranks 4 which, in the embodiment shown herein, are integral with the backrest frame 2 and the base frame 3 of the seat.

The invention claimed is:

1. A mechanism for adjusting the seat of a chair as a result of changing the tilt of the backrest with respect to said seat, said mechanism comprising:

a backrest frame and a base frame as well as a covering element stably combined with said base frame and forming at least part of said seat, said backrest frame being rotatably constrained to said base frame around a respective rotation axis and tilting with respect to the seat between a position (P1) of minimum tilt and a position (P2) of maximum tilt, wherein said covering element is at least partially elastically deformable, said mechanism comprising a lever rotatably constrained to said base frame, said lever having an arm rotationally operated by said backrest frame between a first position in which said backrest frame is in said position (P1) of minimum tilt, and a second position, in which said backrest frame is in said position (P2) of maximum tilt, and vice versa, in order to elastically deform both in the vertical direction and by stretching in the horizontal direction said covering element as a function of the tilt angle said backrest frame has reached with respect to said position (P1) of minimum tilt, wherein said at least partially elastically deformable covering element comprises a central portion which can be raised or lowered and a perimetrical portion with respect to said central portion, said perimetrical portion being geometrically shaped to facilitate the deformation of said covering element, and wherein said perimetrical portion comprises a plurality of weakening slots.

2. Mechanism according to claim 1, wherein said arm of said lever is arranged between said base frame and said covering element.

3. Mechanism according to claim 1, wherein said lever is integral with said backrest frame and is rotatably constrained to said base frame around the same rotation axis as the backrest frame with respect to the base frame.

4. Mechanism according to claim 1, wherein said arm of said lever is combined with said covering element and in that said first position the arm of said lever has reached is a lowered position with respect to said base frame and said second position the arm of said lever has reached is a raised position in which said arm of the lever directly or indirectly deforms upwardly at least part of said covering element.

5. Mechanism according to claim 1, wherein said arm of said lever forms a first crank and the mechanism further comprises a second crank rotatably constrained, directly or indirectly, to said base frame and a crossbar rotatably constrained, directly or indirectly, to said first crank and to said second crank for rotationally moving said second crank while said first crank is rotating between said first position and said second position, said second crank or said crossbar being shaped so as to elastically deform, directly or indirectly, said covering element.

6. The mechanism according to claim 5, wherein said second crank is farther from said backrest frame with respect to said first crank and in that said second crank said first crank and said crossbar are shaped so that said second crank is raised to a larger extent with respect to said first crank when the backrest frame is rotated toward its position (P2) of maximum tilt.

7. The mechanism according to claim 1, wherein said covering element comprises, on its inner side a first coupling to rotatably constrain, directly or indirectly, said arm of the lever to said covering element or second coupling to rotatably constrain, directly or indirectly, a crank to said covering element.

8. The mechanism according to claim 7, wherein said first coupling or said second coupling are arranged at said central portion of said covering element.

9. The mechanism according to claim 1, further comprising returning elastic means for returning said backrest frame.

10. The mechanism according to claim 9, wherein said returning elastic means comprises at least one spring constrained to said lever and to said base frame of said seat.

11. The mechanism according to claim 1, further comprising a padding layer upholstering said covering element.

12. The mechanism according to claim 1, wherein said covering element is made of a plastic material comprising at least polypropylene copolymer and an elastomer.

13. A chair comprising a backrest and a seat, further comprising a mechanism for adjusting the seat of a chair when the tilt of the backrest changes with respect to said seat, between a position (P1) of minimum tilt and a position (P2) of maximum tilt, according to claim 1.

* * * * *